US005881795A

United States Patent [19]

Uptain

[11] Patent Number: 5,881,795

[45] Date of Patent: Mar. 16, 1999

[54] METHOD OF CASTING METAL AROUND GEMS TO FORM ARTICLES OF JEWELRY

[76] Inventor: Clifford L. Uptain, 2240 E. Minton St., Mesa, Ariz. 85213

[21] Appl. No.: 758,996

[22] Filed: Dec. 2, 1996

[51] Int. Cl.[6] ..... B22C 7/02; B22D 19/00

[52] U.S. Cl. ..... 164/9; 164/35

[58] Field of Search ..... 164/9, 35, 10, 164/11, 34, 36, 516, 45

[56] References Cited

U.S. PATENT DOCUMENTS

| | | | |
|---|---|---|---|
| 4,154,282 | 5/1979 | Kull | 164/9 |
| 4,392,289 | 7/1983 | Michaud . | |
| 5,690,477 | 11/1997 | Haimuff | 164/9 |

*Primary Examiner*—Patrick Ryan
*Assistant Examiner*—I.-H. Lin
*Attorney, Agent, or Firm*—John D. Lister

[57] ABSTRACT

A method of manufacturing gem decorated articles, typically jewelry, includes the steps of: using a first mold which has a mold cavity with one or more gem portions for receiving one or more gems and duplicates a model of the article; positioning one or more gems in the mold gem portion(s) of the mold; forming a temporary bond between the gem(s) and the mold gem portion(s) of the mold to maintain the gem(s) in place in the mold gem portion(s) during formation of a wax model including the gem(s); introducing a molten, hardenable wax material into the mold; cooling the wax material to form a wax model reproduction of the article with the gem(s) set therein; ending the temporary bond between the gem(s) and the mold gem portion(s) of the mold; removing the wax model with the set gem(s) from the mold; applying an investment material about the wax model with the set gem(s) and hardening the investment material to form a second mold; removing the wax material from the second mold; introducing a molten metal into the second mold; hardening the metal through cooling to form an article with the gem(s) preset therein; and removing the article from the second mold. If needed, insecurely set gems can be adhesively bonded to the wax model and wax projections can be used to facilitate the removal of the gems with the wax model from the first mold.

27 Claims, 3 Drawing Sheets

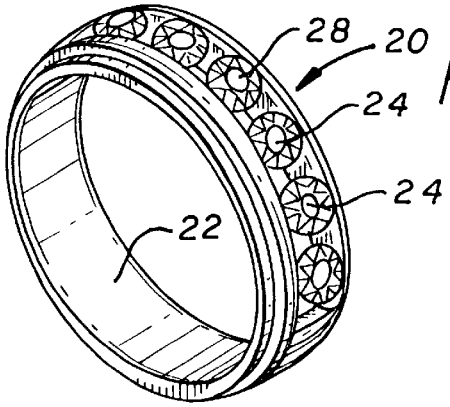
FIG. 1
FIG. 2
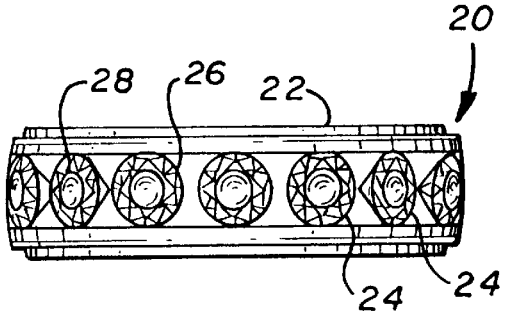
FIG. 3
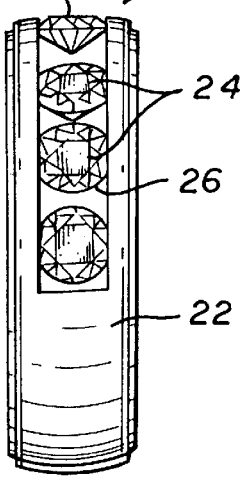
FIG. 4
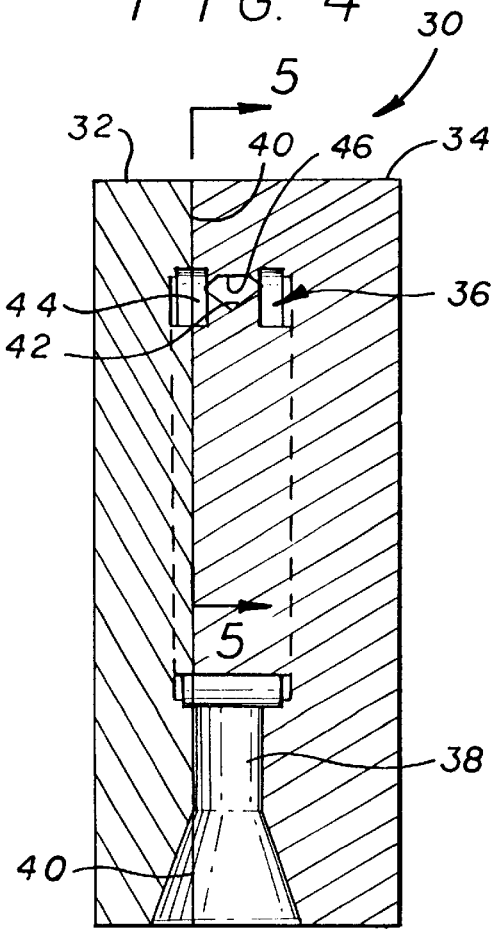
FIG. 7
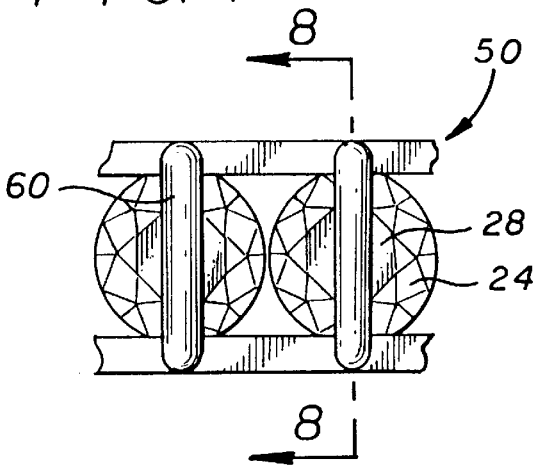

METHOD OF CASTING METAL AROUND GEMS TO FORM ARTICLES OF JEWELRY

BACKGROUND OF THE INVENTION

The present invention relates to a method of making articles of jewelry with one or more gems set in a metal support or setting and, more specifically, to a method of making articles of jewelry wherein one or more gems are properly set into the articles of jewelry during the casting of the metal support or setting.

Articles of jewelry are commonly formed by casting a precious metal support or setting and thereafter manually placing a gem or gems in position on the precious metal support or setting and anchoring the gem or gems in place in or on the precious metal support or setting, e.g. by hammering and moving metal or by bending prongs or other anchoring elements over facets of the gem or gems. A great deal of time and skill is required to properly orient and anchor the gem or gems in place, especially when several gems are being set in the support or setting. Thus, this procedure of making or manufacturing articles of jewelry greatly increases the cost of making or manufacturing such articles of jewelry and frequently, if one or more gems are not properly anchored in the support or setting, the gems become loose and are lost or the article of jewelry must be repaired.

U.S. Pat. No. 4,154,282; issued May 15, 1979; inventor, Herbert Kull; (hereinafter the "Kull Patent") discloses a method of manufacturing articles of jewelry with a single gem set in the precious metal support during the casting process. While an improvement over the method of making such articles of jewelry described above, the method of manufacturing articles of jewelry disclosed in the Kull Patent still presents manufacturing problems. As pointed out in U.S. Pat. No. 4,392,289; issued Jul. 12, 1983; inventor Franck Michaud; (hereinafter the "Michaud Patent"), the method described in the Kull Patent presents a problem with respect to maintaining the gem in its proper position and orientation during the formation of the wax model reproduction of the article of jewelry, especially when several gems are being set in the wax model reproduction. In the Kull Patent method of making an article of jewelry, a high degree of care must be exercised in closing the open rubber mold, after the gem(s) have been positioned in the open rubber mold, to keep from displacing the gem(s) prior to injecting the wax material to form the wax model reproduction, especially when several gems are being set in the wax model. The displacement of the gem(s), prior to the formation of the wax model reproduction, is not apparent until the wax model has been removed from the rubber mold thereby necessitating the removal of the gem(s) from the wax model after the wax model has been formed, the discarding of the wax model, and the repositioning of the gem(s) in the rubber mold to again attempt to form a wax model of the article of jewelry with the gem(s) properly positioned and oriented in the wax model.

The Michaud Patent attempts to solve the problem of gem displacement by forming rubber molds, from the article of jewelry to be reproduced, with opposing undercut grooves located in the sidewalls of the seats of each gem setting to engage portions of the girdles of the gems as the means of securing or anchoring the gems in the wax material model. An elastic wax material is introduced into the rubber mold to form the wax model. After the elastic wax model is removed from the rubber mold, the gems are "snapped" into their set position in the seats of the elastic wax model with the girdle of the gem in the opposed undercut grooves.

The method set forth in the Michaud Patent may solve some of the problems associated with the method disclosed in the Kull Patent. However, there has remained a need for a method of making such articles of jewelry which assures the accurate placement and orientation of the gems in the article of jewelry: without restricting the article of jewelry to those wherein each gem of the article is positioned relative to the precious metal support and other gems so that the mold can be provided with a seat with undercut grooves to hold each gem; and without requiring the sizes or dimensions and shapes of the gem girdles to be uniform.

Almost all diamonds and other gems are individually cut by hand and polished. Accordingly, the shapes and dimensions or sizes of the girdles of these hand cut gems differ. Even with respect to gems which are categorized as the same in dimensions or size and shape, there will be at least slight differences in the thicknesses or other dimensions of the girdles and the shape of the girdle will vary with some gems having a more sharply defined girdle and other gems having a more rounded girdle. Thus, when these gems are "snapped" into the undercut grooves, even for gems categorized as having the same size or dimensions and shape, there will be differences in the sizes or dimensions and shapes of the gems which will cause at least some of the gem seats to be expanded more than adjacent gem seats. While the wax materials used in processes, such as the Michaud process, may be somewhat elastic, in most instances the wax materials are not elastic enough to compensate for the over expansion of one gem seat (by the insertion of a gem) relative to adjacent gem seats. Accordingly, gems, having smaller dimensions or sizes and shapes, inserted into these adjacent gem seats will not be securely held in place. This problem is amplified when gems of different sizes and shapes are to be mounted adjacent each other in such a setting. There has also been a need to provide a method of making such articles of jewelry without requiring the use of elastic wax materials.

SUMMARY OF THE INVENTION

The method of making jewelry of the present invention assures that the gem(s) of a wax model reproduction of an article of jewelry are accurately and properly positioned and oriented for the formation of the disposable investment material mold from which the article of jewelry with the gem(s) preset therein is formed. The method of the present invention also provides the jeweler with wide discretion as to the design of the article of jewelry and the arrangement of the gem(s) in the article of jewelry with no need to provide seats with opposed undercut grooves for each gem or to use elastic wax materials for the wax model. Furthermore, the method of the present invention ensures that the gems will be set much more securely in the wax model reproduction with better accuracy and more exact spacing.

The method of the present invention includes the steps of: using a first mold, which has a mold cavity that has a minimum of one gem portion for receiving one or more gems and is a duplicate of a model of the article of jewelry; positioning one or more gems in the mold gem portion(s) of the mold cavity; forming a temporary bond, preferably with an soluble adhesive, between the gem(s) and the mold gem portion(s) of the mold cavity to maintain the gem(s) in place in the mold gem portion(s) during formation of a wax model including the gem(s); introducing a molten, hardenable wax preform material into the mold cavity and cooling the wax preform material to form a wax model reproduction of the article of jewelry with the gem(s) set therein; ending the temporary bond between the gem(s) and the gem mold portion(s) of the mold cavity; removing the wax model with the set gem(s) from the mold cavity; applying an investment material about the wax model with the set gem(s) and hardening the investment material to form a second mold; removing the wax preform material from the second mold; introducing a molten metal (e.g. precious metal) into the second mold; hardening the metal to form an article of jewelry with the gem(s) preset therein; and removing the article of jewelry from the second mold.

As mentioned above, preferably, the temporary bond between the gem(s) and the mold gem portion(s) of the first mold cavity is formed by adhesively bonding the gem(s) to the mold gem portion(s) with a soluble adhesive (e.g. a water soluble adhesive) and the temporary bond between the gem(s) and the mold gem portion(s) of the mold cavity may be ended by applying a solvent (e.g. water in the case of a water soluble adhesive) to the adhesive which dissolves the soluble adhesive without adversely affecting the first mold or the wax preform material forming the wax model of the article of jewelry. While the bond between the gems and the mold gem portion(s) of the mold cavity may be ended by applying a solvent to the adhesive, in some instances the bond can be ended merely by pulling the gem(s) away from the mold gem portion(s) of the mold as the wax model is removed from the mold.

The method of manufacturing articles of jewelry of the present invention can also include the steps of determining if the gem(s) are securely set in the wax model; and, if any of the gem(s) are insecurely set in the wax model, a temporary bond between the insecurely set gems and the wax model can be formed with an adhesive to securely hold said gems in the wax model. The temporary bond between the previously insecurely set gems and the wax model is ended or eliminated upon the removal of the wax preform material from the second mold e.g. by an application of heat to this mold during the burn out process which melts or vaporizes and removes the wax preform material from the investment mold and eliminates the adhesive from the investment mold.

The method of manufacturing articles of jewelry according to the present invention can also include forming temporary wax projections over at least selected gems in the wax model to facilitate the removal of the selected gems with the wax model from the first mold. After the wax model is removed from the first mold, the temporary wax projections are preferably removed from the selected gems and the wax model prior to the application of the investment material to the wax model to form the investment mold. However, in some instances, the temporary wax projections are not removed at this stage of the process. Instead, the wax projections are left in place; the investment mold is formed about the wax model reproduction; the wax model reproduction is burned out of the investment mold; the article of jewelry is cast; and the metal projections corresponding to the temporary wax projections are removed from the metal support or setting after the article of jewelry has been cast.

The method of manufacturing articles of jewelry according to the present invention can also include bonding together at least selected gems, prior to the placement of the gems in the first mold, with an adhesive that holds the gems together until the adhesive is eliminated from the second mold along with said removal of the wax preform material during the burn out process.

BRIEF DESCRIPTION OF THE DRAWINGS

FIG. 1 is a perspective view of a finished ring, with gems preset therein in accordance with the method of the present invention, which is a reproduction of a master ring.

FIG. 2 is a top view of the finished ring of FIG. 1.

FIG. 3 is a side view of the finished ring of FIG. 1.

FIG. 4 is a sectional view of a rubber mold made from a master ring, that is used to make a wax model ring reproduction of the master ring during the manufacture of the finished ring of FIGS. 1–3, taken perpendicular to a plane of the rubber mold containing the abutting surfaces of two separable sections of the rubber mold and passing through the gem setting seats of the rubber mold.

FIG. 7 is an enlarged top view of a portion of a wax model ring reproduction of the master ring used in one embodiment of the method of the present invention for making the finished ring of FIGS. 1–3, with a wax release bar passing over the upper or outer surface of two of the gems in the wax model reproduction.

DESCRIPTION OF THE PREFERRED EMBODIMENTS

FIGS. 1–3 show a finished ring 20 with a metal support or setting 22 and a plurality of gems 24 preset in the metal support or setting 22 of the finished ring 20 in accordance with the method of the present invention. The finished ring of FIGS. 1–3 is, in shape, a duplicate or reproduction of a master ring and an intermediate wax model ring reproduction of the master ring (except for the presence of a wax sprue which may be left extending from the shank of the wax model ring reproduction for casting operations). Thus, figures of the master ring and the wax model ring reproduction have not been included in addition to FIGS. 1–3 of the finished ring 20 to avoid duplication.

While the method of the present invention is hereinafter described in connection with the manufacture of precious metal rings with gems preset therein, the method of the present invention for manufacturing articles of jewelry can also be used in the manufacture of a wide variety of gem decorated articles of jewelry and jewelry parts including, but not limited to, bracelets, brooches, cuff links, earrings, lockets, pendants, pins, tie pins and other gem containing articles. While the metals used to form the finished ring are typically gold or silver, many other metals and metal alloys can also be used to form the metal supports for the gems. The gems used in the articles of jewelry can be any of a variety of precious or semi-precious gems or gem stones including, but not limited to, diamonds, rubies, sapphires, garnets, and various other crystals and gem stones. The gems may be cut in any of the numerous shapes commonly used for gem decorated articles of jewelry including, but not limited to, round, square, baguette, marquise, triangular, oval, and pear.

The method of the present invention normally includes the use of a reusable mold, e.g. a rubber mold, having all of the design features including the gems of the gem decorated article of jewelry to be manufactured by the method of the present invention. However, in some cases, the gem portion of the ring and/or mold may be altered. The reusable mold is typically formed by molding the reusable mold about a master metal model of the gem decorated article of jewelry to be manufactured. Typically, the master metal model is specifically made for this purpose. However, an existing gem decorated article of jewelry of which copies are desired can sometimes or in many cases be used to form the reusable mold.

Figure 5:
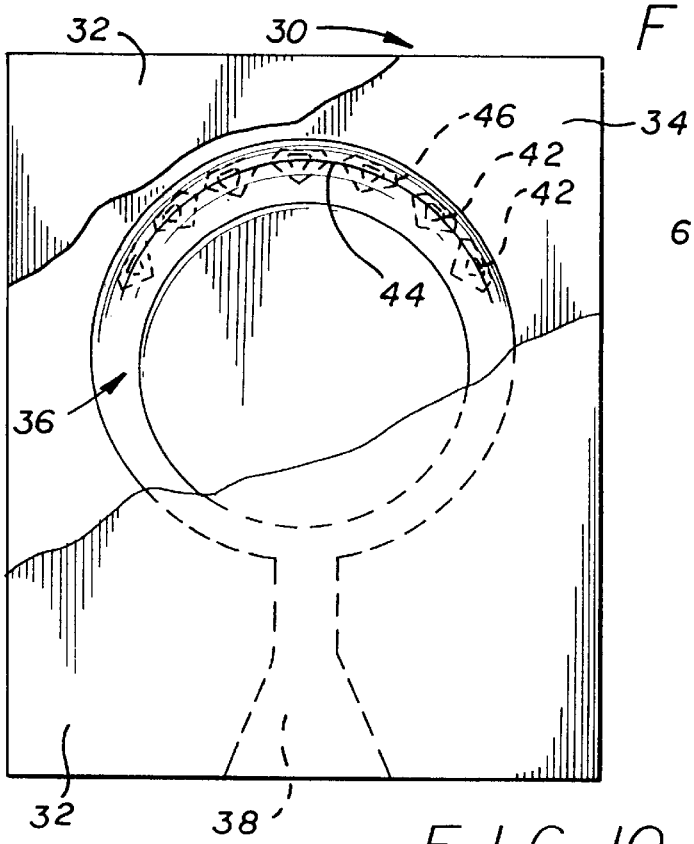
FIG. 5 is a front view of the rubber mold of FIG. 4, with a portion broken away substantially along lines 5—5 of FIG. 4.

For manufacturing the finished gem decorated ring 20 of FIGS. 1–3, a master metal model ring, shaped in most cases exactly like the finished gem decorated ring 20, is used to make a reusable mold 30, e.g. a pliable rubber mold, by a method well known in the art. The reusable mold 30, shown in FIGS. 4 and 5, includes two mold sections 32 and 34 which when closed as shown in FIGS. 4 and 5 form a cavity 36 duplicating the shape of the master metal model ring and the finished gem decorated ring 20, plus a sprue 38 for introducing a wax material into the mold 30. As shown, the mold sections 32 and 34 are separable along a parting plane 40 which essentially coincides with lines 5—5 of FIG. 4. As shown, the gem decorated ring 20 includes seven gems and the mold cavity 36 has seven gem seats 42 to accommodate the gems 24 being used to decorate the ring 20. The gems 24 are positioned in the gem seats 42 by flexing the mold section 34 to separate the mold section 34 along a semicircular cut 44 which typically coincides or essentially coincides with the location of the girdles 26 of the gems 24 when the gems 24 are positioned in the gem seats 42.

In the method of the present invention, the gems 24 are temporarily bonded to the interior surface of the mold gem portion of the cavity 36 to maintain the gems in their proper positions and orientations during the closing of the mold 30, the introduction of a hardenable wax or wax-like or wax substitute preform material (herein referred to as a "wax preform material") into the mold cavity 36; and the hardening of the wax perform material in the mold cavity 36 to form a wax model ring reproduction 50 of the master metal model ring with the gems 24 set in the wax model ring reproduction 50.

Preferably, the gems 24 are temporarily bonded to the interior surface of the mold gem portion(s) of the cavity by using a soluble adhesive which is typically placed on the table surface 28 of each of the gems 24 prior to inserting each gem into its gem seat 42 or on the surface 46 of the interior of the mold cavity 36 in contact with the table surface 28 of the gem when each gem 24 is placed in the gem seat 42. By applying the soluble adhesive to either an exterior surface of a gem 24 (e.g. the table surface 28 or some other surface) or a portion of the interior surface of the mold cavity 36 in contact with a gem 24 (e.g. surface portion 42 and/or 46) and permitting the adhesive to set prior to closing the mold sections 32 and 34 together and preferably prior to allowing the semicircular cut 44 to close, the gems so bonded to the mold gem portion(s) of the mold cavity 36 are retained in the desired location and orientation during the injection of the hardenable wax preform material into the mold cavity 36 and the formation of the wax model ring reproduction. After the hardenable wax preform material has been introduced into the mold cavity 36 and allowed to harden, the section 32 and 34 are separated along the parting plane 40. If needed, a solvent is then applied to the soluble adhesive through the semicircular cut 44 to dissolve the soluble adhesive temporarily bonding the gems 24 to the interior surface of the mold gem portion(s) of the mold cavity 36. Preferably, the solvent does not adversely affect the material of the mold, e.g. rubber, and one preferred type of adhesive used in the method of the present invention is a water soluble adhesive. While the bond between the gems and the mold gem portion(s) of the mold cavity are typically ended by applying a solvent to the adhesive, in some instances the bond can be ended merely by pulling the gem(s) away from the mold gem portion(s) of the mold cavity when removing the wax model ring reproduction 50 from the mold 30. Once the temporary bond between the gems 24 and the interior surface of the mold gem portion(s) of the mold cavity 36 has been ended or eliminated, e.g. by dissolving the adhesive, the wax model ring reproduction 50, with the gems 24 set therein is removed from the mold 30 with a sprue 52 extending from the shank and any excess adhesive or bonding material on the gem(s) is removed.

While the gems 24 are normally firmly set in the wax model ring reproduction 50 by the method of the present invention, preferably, the wax model ring reproduction 50 is checked after removing it from the mold 30 to determine if all of the gems 24 are firmly set in the wax model ring reproduction. If any of the gems 24 are insecurely anchored or set in the wax model ring reproduction 50, the insecurely set or anchored gems 24 can be temporarily bonded to the gem support of wax model ring reproduction, typically by applying adhesive between the exterior surface of the insecure gem in the region of its girdle 26 and the opposing surface of the gem support or setting of the wax model ring reproduction 50. Preferably, the adhesives used are quick setting adhesives (e.g. DURO SUPER GLUE adhesive, sold by Loctite Corporation of Cleveland, Ohio) which have a melting, vaporization or removal temperature approximately equal to or, preferably, less than the removal temperature of the hardenable wax preform material of the wax model ring reproduction 50. Accordingly, when the hardenable wax preform material of the wax model ring reproduction 50 is removed from the investment material mold 54 by melting and/or vaporizing the hardenable wax preform material, the adhesive that was used to temporarily bond any of the gems 24 to the wax model ring reproduction 50 is also eliminated from the mold cavity formed in the investment mold 54.

Figure 14:
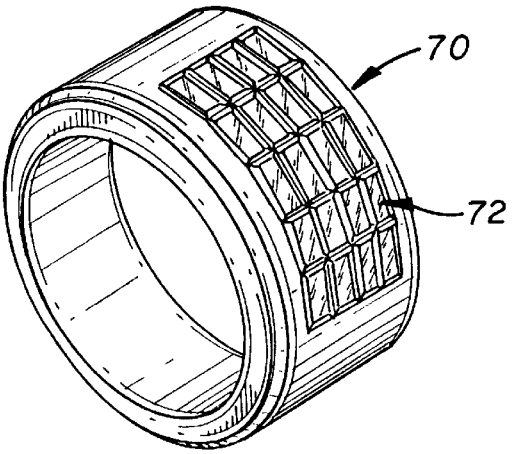
FIG. 14 is a perspective view of a finished ring with gems preset therein in accordance with the method of the present invention which is a reproduction of a master ring.

Once the wax model ring reproduction 50 has been removed from the mold 30; preferably checked to determine if any of the gems 24 are insecurely anchored or set in the wax model ring reproduction; and any loose or insecurely anchored gems 24 are preferably bonded to the wax model ring reproduction; the investment mold 54 is formed for casting the metal article of jewelry 20 with the gems 24 preset therein. As is conventional in the lost wax procedure, the wax model ring reproduction 50 (formed in the mold 30 with the gems 24 set therein) is mounted on a wax tree with other wax model reproductions and the wax tree is in turn supported on a sprue base and surrounded by a cylindrical flask or the like into which the investment slurry is carefully poured, or the solitary wax model ring reproduction with the sprue attached, is surrounded by a cylindrical flask or the like into which the investment slurry is carefully poured. After the investment material hardens, the sprue base is removed. The flask is heated in an oven to both cure the investment material and eliminate the hardenable wax preform material from the mold cavity formed in the investment mold 54 by the wax model ring reproduction 50. This prepares the investment mold 54 for the casting of the finished gem decorated ring 20. As discussed above, if adhesive has been used to temporarily bond any of the gems 24 to the wax model ring reproduction 50 or to temporarily bond any of the gems together as further discussed hereinafter in connection with FIGS. 14–16, the adhesive is also eliminated from the investment mold cavity along with the hardenable wax preform material.

The shape of the investment mold cavity is the same as or essentially the same as the cavity 36 of mold 30, with the following exception. Where the mold 30 has gem receiving cavities defined between the seats 42 and opposing surfaces 46, the investment mold 54 has the gems 24 embedded therein so that when the molten metal which hardens into the ring support or setting 22 is introduced into the cavity of the investment mold 54 and hardened, the gems 24 become preset in the ring support or setting 22 to form the gem decorated ring 20 with preset gems.

Figure 8:
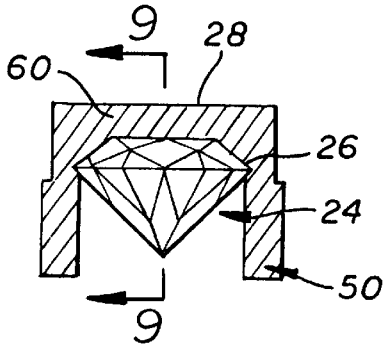
FIG. 8 is a transverse view of the portion of the wax model ring reproduction shown in FIG. 7, taken substantially along lines 8—8 of FIG. 7.
Figure 9:
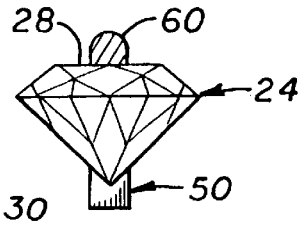
FIG. 9 is a transverse view of the portion of the wax model ring reproduction shown in FIG. 8, taken substantially along lines 9—9 of FIG. 8.
Figure 6:
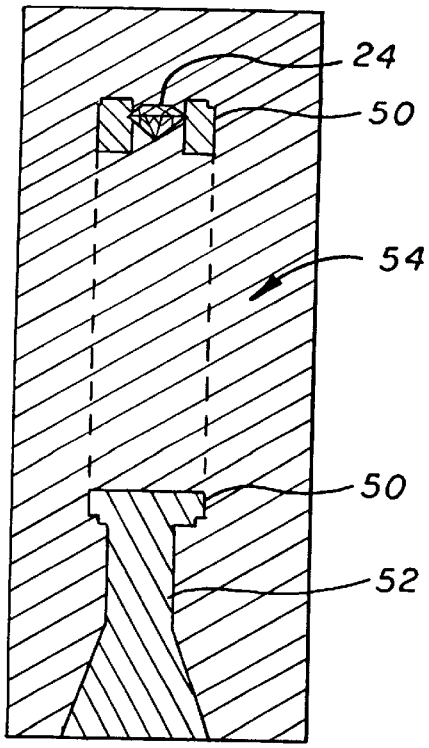
FIG. 6 is a sectional view of an investment mold, with the wax model ring reproduction therein.
Figure 10:
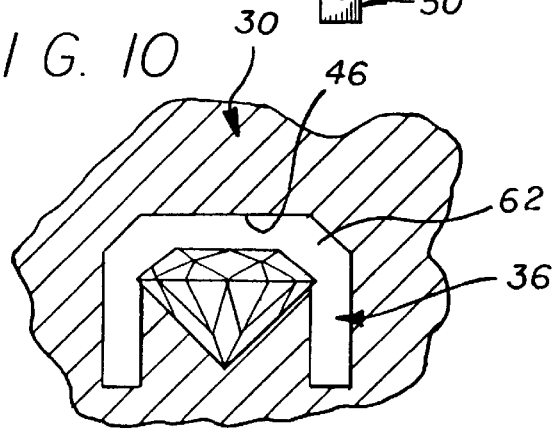
FIG. 10 is a transverse view through the gem seat portion of a mold modified to form the wax release bar of FIGS. 7–9.

FIGS. 7–9 show the use of temporary wax projections or release bars 60 to facilitate the removal of the gems 24 from the mold cavity 36 with the wax model ring reproduction 50. As shown in FIG. 10, a groove or recess 62 is provided in the surface 46 of the mold cavity 36. The groove or recess 62 is typically burned into the surface of the rubber mold after the mold is formed and extends from one side of the gem 24 to the other side of the gem, over the table surface 28 of the gem and between the portions of the cavity 36 that form the wax model reproduction of the metal support or setting 22 of the master metal model ring. Thus, when the mold cavity 36 is filled with molten hardenable wax preform material, the molten, hardenable wax preform material flows into the recesses 62 and forms the temporary wax projections or release bars 60. The use of these temporary wax projections or release bars is especially helpful in facilitating the removal of gems from the mold cavity 36 and in structurally reinforcing the gem support or setting of the wax model ring reproduction 50.

Once the wax model ring reproduction 50 is removed from the mold cavity 36 of the mold 30, the release bars 60, when used, are generally removed, e.g. cut away, prior to forming the investment mold 54 about the wax model ring reproduction 50. However, in some instances, the temporary release bars 60 are not removed at this stage of the process. Instead, the release bars 60 are left in place; the investment mold 54 is formed about the wax model ring reproduction 50; the wax model ring reproduction is burned out of the investment mold 54; the article of jewelry is cast; and the metal bars corresponding to the temporary wax release bars 60 are removed from the metal support or setting after the article of jewelry has been cast.

Figure 11:
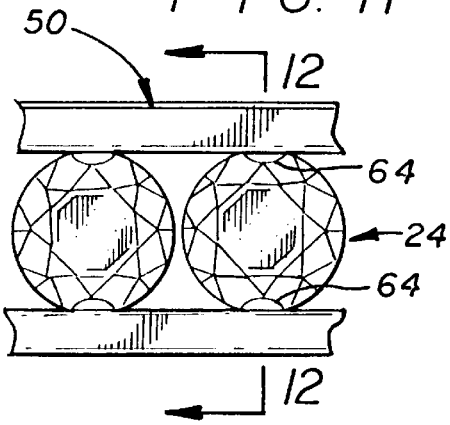
FIG. 11 is an enlarged top view of a portion of a wax model ring reproduction of the master ring used in another embodiment of the method of the present invention for making the finished ring of FIGS. 1–3, with a pair of wax release projections passing over portions of the upper or outer surfaces of two gems in the wax model reproduction.
Figure 12:
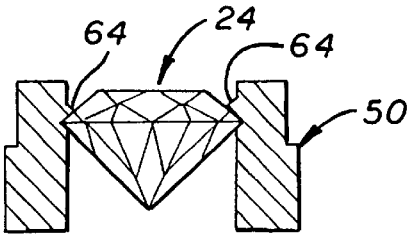
FIG. 12 is a transverse view of the portion of the wax model reproduction shown in FIG. 11, taken substantially along lines 12—12 of FIG. 11.
Figure 13:
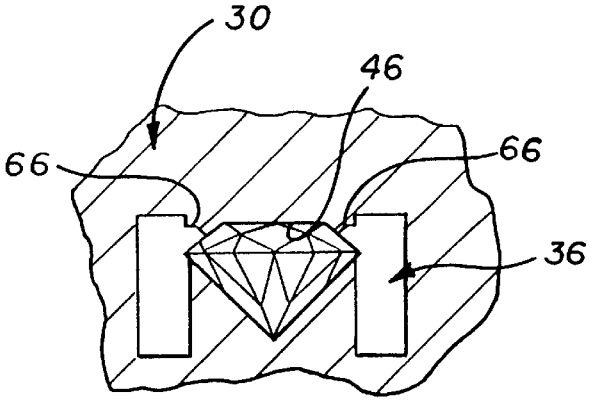
FIG. 13 is a transverse view through the gem seat portion of a mold modified to form the wax retaining projections of FIGS. 11 and 12.

FIGS. 11 and 12 show the use of pairs of temporary wax projections 64 to facilitate the removal of the gems 24 from the mold cavity 36 with the wax model ring reproduction 50. As shown in FIG. 13, pairs of recesses 66 are provided in the surface 46 of the mold cavity 36 on opposite sides of the gem 24 adjacent the girdle 26 of the gem and connected to the portions of the cavity 36 that form the wax model reproduction of the metal support 22 of the master metal model ring. Thus, when the mold cavity 36 is filled with molten, hardenable wax preform material, the hardenable wax preform material flows into the recesses 66 and forms the pairs of temporary wax projections 64. Like the release bars 60, the use of these temporary wax projections 64 is especially helpful in facilitating the removal of gems from the mold cavity 36.

Once the wax model ring reproduction 50 is removed from the mold cavity 36 of the mold 30, the release projections 64, when used, are generally removed, e.g. cut away, prior to forming the investment mold 54 about the wax model ring reproduction 50. However, in some instances, the temporary release projections 64 are not removed at this stage of the process. Instead, the release projections 64 are left in place; the investment mold 54 is formed about the wax model ring reproduction 50; the wax model ring reproduction is burned out of the investment mold 54; the article of jewelry is cast; and the metal bars corresponding to the temporary wax release projections 64 are removed from the metal support or setting after the article of jewelry has been cast.

Figure 15:
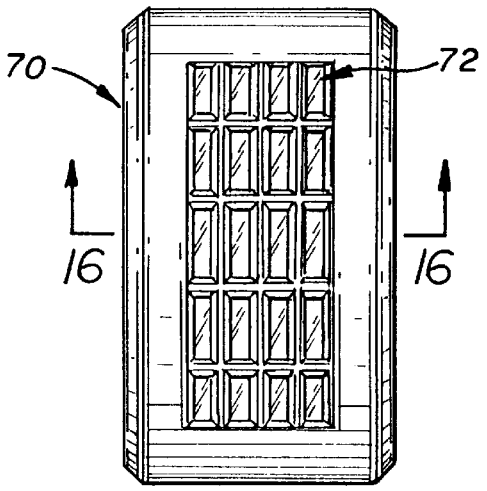
FIG. 15 is a top view of the finished ring of FIG. 14.
Figure 16:
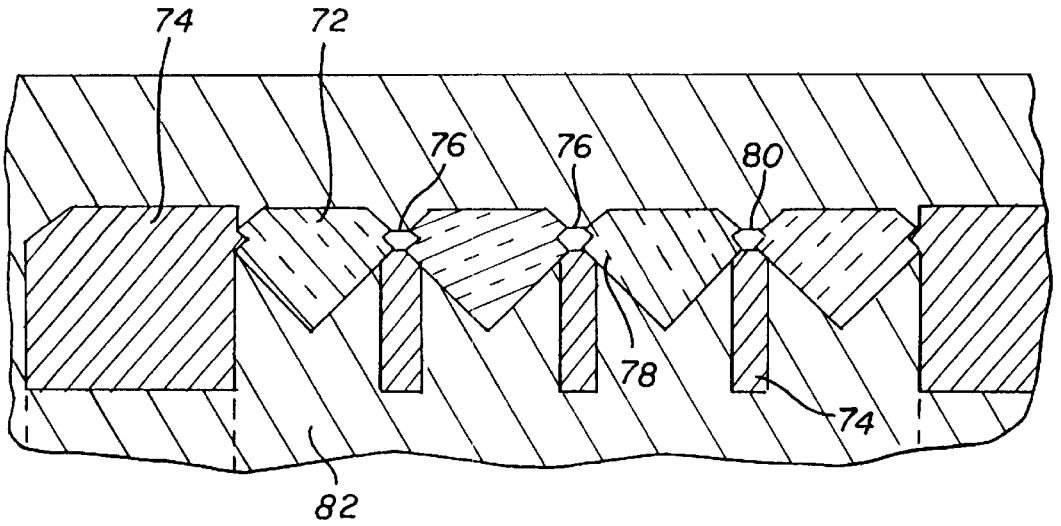
FIG. 16 is a view, corresponding to a view taken substantially along lines 16—16 of FIG. 15, of a portion of the wax model ring reproduction used in the method of the present invention to make the finished ring of FIGS. 14 and 15, in the investment mold used in the method of the present invention to form the finished ring of FIGS. 14 and 15, prior to the elimination of the wax preform material and adhesive from the investment mold.

FIGS. 15 and 16 show a finished gem decorated ring 70 wherein a plurality of gems 72 are preset in the ring during the casting step of the manufacturing process in accordance with the method of the present invention. The method of manufacturing the finished gem decorated ring 70 is basically the same as that described above in connection with the finished gem decorated ring 20 of FIGS. 1–3, with the exception of an additional method step of bonding at least some of the gems 72 together prior to placing the gems in the mold gem portion of the cavity in a mold like the mold 30 to form the wax model ring reproduction 74 of the master metal ring. As shown in FIG. 16, the gems 72 are preferably provided with notches 76 at or below the girdles 78 of the gems and a wax and/or an adhesive 80 placed in the notches 76 and extending between adjacent gems bonds the gems together so that the gems can be placed in a mold 30 together to form the wax model ring reproduction 74. After the removal of the wax model ring reproduction 74 from the mold used to form the wax model ring reproduction, an investment mold 82 is formed about the wax model ring reproduction as described above in connection with the wax model ring reproduction 50.

FIG. 16 is a section through the investment mold 82 showing the wax model ring reproduction 74 within the investment mold 82 prior to the elimination of the hardenable wax preform material forming the wax model ring reproduction 74 through the application of heat. The adhesive 80 bonding the gems 72 together is also present and is eliminated from the mold cavity of the investment mold 82 when the hardenable wax preform material is eliminated from the cavity of the investment mold 82. The adhesive 80 used to bond the gems 72 together is not soluble in the solvent used to eliminate or end the bond between the gems 72 and the mold cavity of the mold used to form the wax model ring reproduction 74 so that the application of a solvent to remove the wax model ring reproduction 74 from the mold does not adversely affect the bond between the gems 72 formed by the adhesive 80. Preferably, the adhesive

80 is a fast drying adhesive, of the type mentioned above, having a melting, vaporizing or removal temperature about equal to or preferably less than the removal temperature of the hardenable wax preform material used to form the wax model ring reproduction 74. After the hardenable wax preform material and the adhesive 80 have been eliminated from the mold cavity of the investment mold 82 and the investment material has been cured, the molten metal used to form the support or setting of the finished gem decorated ring 70 is introduced into the mold cavity and flows into the spaces between the gems 72 vacated by the adhesive 80 to preset the gems 72 in the metal support or setting during the casting process of the method of the present invention.

In describing the invention, certain embodiments have been used to illustrate the invention and the practices thereof and as discussed above, the method of the present invention can be used to make a variety of gem decorated articles of jewelry in addition to rings. Thus, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A method of manufacturing articles of jewelry each including a metal setting with a gem set therein, comprising the steps of: using a first mold having a mold cavity within said first mold duplicating the shape of a model of an article of jewelry; said mold cavity of said first mold having a mold gem portion for receiving a gem and being formed of a pair of mold sections with molding surfaces which are complementary to outer opposite surfaces of said model; said mold sections being moveable relative to each other to permit an opening and a closing of said first mold; opening said first mold and positioning a gem in said mold gem portion of said first mold; forming a temporary bond between said gem and said mold gem portion of said first mold to maintain said gem in place in said mold gem portion during formation of a wax model including said gem; closing said first mold, introducing a molten, hardenable wax preform material into said first mold; hardening said preform material in said first mold to form a wax model reproduction of the article of jewelry with said gem set in said wax model reproduction; ending said temporary bond between said gem and said mold gem portion of said first mold; removing said wax model reproduction with the set gem from said first mold; applying an investment material about said wax model reproduction with the set gem and hardening said investment material to form a second mold; removing said wax preform material from said second mold; introducing a molten metal into said second mold; hardening said metal to form an article of jewelry with said gem preset therein; and removing said article of jewelry from said second mold.

2. The method of manufacturing articles of jewelry according to claim 1, wherein: said temporary bond between said gem and said mold gem portion of said first mold is formed by adhesively bonding said gem to said mold gem portion with a soluble adhesive.

3. The method of manufacturing articles of jewelry according to claim 2, wherein: said temporary bond between said gem and said mold gem portion is ended by applying a solvent to said adhesive which dissolves said soluble adhesive without adversely affecting said first mold or said wax preform material.

4. The method of manufacturing articles of jewelry according to claim 3, wherein: said adhesive is a water soluble adhesive and said temporary bond between the gem and said mold gem portion is ended by applying water to said adhesive which dissolves said water soluble adhesive without adversely affecting said first mold or said wax preform material.

5. The method of manufacturing articles of jewelry according to claim 3, including: determining if said gem is securely set in said wax model; and, if said gem is not securely set in said wax model, forming a temporary bond between said gem and said wax model to securely hold said gem in said wax model; and ending said temporary bond between said gem and said wax model upon said removal of said wax preform material from said second mold.

6. The method of manufacturing articles of jewelry according to claim 5, wherein: said temporary bond between said gem and said wax model is formed by adhesively bonding said gem to said wax model with an adhesive; and said temporary bond between said gem and said wax model is ended by an application of heat to said second mold which removes said wax preform material from said second mold and eliminates said adhesive from said second mold.

7. The method of manufacturing articles of jewelry according to claim 6, wherein: said mold gem portion of said first mold has recess means therein for the reception of said wax preform material during said formation of said wax model to form a temporary wax projection means over said gem to facilitate removal of said gem with said wax model from said first mold; and said recess means is filled with said wax preform material upon formation of said wax model to form said temporary wax projection means before removing said wax model from said first mold.

8. The method of manufacturing articles of jewelry according to claim 7, including: removing said temporary wax projection means from said gem and said wax model after said wax model has been removed from said first mold and prior to said application of said investment material to said wax model to form said second mold.

9. The method of manufacturing articles of jewelry according to claim 8, wherein: said recess means in said mold gem portion of said first mold passes from a first side of said mold gem portion to a second side of said mold gem portion; and said temporary wax projection means is a bar passing over said gem.

10. The method of manufacturing articles of jewelry according to claim 1, wherein: said mold gem portion of said first mold has recess means therein for the reception of said wax preform material during said formation of said wax model to form a temporary wax projection means over said gem to facilitate removal of said gem with said wax model from said first mold; and said recess means is filled with said wax preform material upon formation of said wax model to form said temporary wax projection means before removing said wax model from said first mold.

11. The method of manufacturing articles of jewelry according to claim 10, including: removing said temporary wax projection means from said gem and said wax model after said wax model has been removed from said first mold and prior to said application of said investment material to said wax model to form said second mold.

12. The method of manufacturing articles of jewelry according to claim 11, wherein: said recess means in said mold gem portion of said first mold passes from a first side of said mold gem portion to a second side of said mold gem portion; and said temporary wax projection means is a bar passing over said gem.

13. The method of manufacturing articles of jewelry according to claim 1, wherein: said articles of jewelry are rings.

14. A method of manufacturing articles of jewelry each including a metal setting with a plurality of gems set therein, comprising the steps of: using a first mold having a mold cavity therein duplicating the shape of a model of an article of jewelry; said first mold having a mold gem portion for receiving a plurality of gems and being formed of a pair of mold sections with molding surfaces which are complementary to outer opposite surfaces of said model; said mold sections being moveable relative to each other to permit an opening and a closing of said first mold; opening said first mold and positioning a plurality of gems in said mold gem portion of said first mold; forming a temporary bond between said gems and said mold gem portion of said first mold to maintain said gems in place in said mold gem portion during formation of a wax model including said gems; closing said first mold, introducing a molten, hardenable wax preform material into said first mold, and hardening said wax preform material in said first mold to form a wax model reproduction of the article of jewelry with said gems set in said wax model reproduction; ending said temporary bond between said gems and said mold gem portion of said first mold; removing said wax model reproduction with the set gems from said first mold; applying an investment material about said wax model reproduction with the set gems and hardening said investment material to form a second mold; removing said wax preform material from said second mold; introducing a molten metal into said second mold; hardening said metal to form an article of jewelry with said gems preset therein; and removing said article of jewelry from said second mold.

15. The method of manufacturing articles of jewelry according to claim 14, wherein: said temporary bond between said gems and said mold gem portion of said first mold is formed by adhesively bonding said gems to said mold gem portion with a soluble adhesive.

16. The method of manufacturing articles of jewelry according to claim 15, wherein: and said temporary bond between said gems and said mold gem portion is ended by applying a solvent to said adhesive which dissolves said soluble adhesive without adversely affecting said first mold or said wax preform material.

17. The method of manufacturing articles of jewelry according to claim 16, wherein: said adhesive is a water soluble adhesive and said temporary bond between said gems and said mold gem portion is ended by applying water to said adhesive which dissolves said water soluble adhesive without adversely affecting said first mold or said wax preform material.

18. The method of manufacturing articles of jewelry according to claim 16, including: determining if said gems are securely set in said wax model; and, if any of said gems are insecurely set in said wax model, forming a temporary bond between said insecurely set gems and said wax model to securely hold said gems in said wax model; and ending said temporary bond between said insecurely set gems and said wax model upon said removal of said wax preform material from said second mold.

19. The method of manufacturing articles of jewelry according to claim 18, wherein: said temporary bond between said insecurely set gems and said wax model is formed by adhesively bonding said insecurely set gems to said wax model with an adhesive; and said temporary bond between said insecurely set gems and said wax model is ended by an application of heat to said second mold which removes said wax preform material from said second mold and eliminates said adhesive from said second mold.

20. The method of manufacturing articles of jewelry according to claim 19, wherein: said mold gem portion of said first mold includes a recess means for the reception of said wax preform material during said formation of said wax model to form temporary wax projection means over at least selected gems of said gems to facilitate removal of said selected gems with said wax model from said first mold; and said recess means is filled with said wax preform material upon formation of said wax model to form said temporary wax projection means before removing said wax model from said first mold.

21. The method of manufacturing articles of jewelry according to claim 20 including: removing said temporary wax projection means from said selected gems and said wax model after said wax model has been removed from said first mold and prior to said application of said investment material to said wax model to form said second mold.

22. The method of manufacturing articles of jewelry according to claim 21, wherein: said recess means in said mold gem portion of said first mold for each of said selected gems passes from a first side of said mold gem portion to a second side of said mold gem portion; and said temporary wax projection means for each of said selected gems is a bar passing over each of said selected gems.

23. The method of manufacturing articles of jewelry according to claim 16, including the bonding together at least certain of said gems with an adhesive, wax or wax-like material that is eliminated from said second mold along with said removal of said wax preform material.

24. The method of manufacturing articles of jewelry according to claim 14, wherein: said mold gem portion of said first mold includes a recess means therein for the reception of said wax preform material during said formation of said wax model to form a temporary wax projection means over at least selected gems of said gems to facilitate removal of said selected gems with said wax model from said first mold; and said recess means is filled with said wax preform material upon formation of said wax model to form said temporary wax projection means before removing said wax model from said first mold.

25. The method of manufacturing articles of jewelry according to claim 24, including: removing said temporary wax projection means from said selected gems and said wax model after said wax model has been removed from said first mold and prior to said application of said investment material to said wax model to form said second mold.

26. The method of manufacturing articles of jewelry according to claim 25, wherein: said recess means in said mold gem portion of said first mold for each of said selected gems passes from a first side of said mold gem portion to a second side of said mold gem portion; and said temporary wax projection means for each of said selected gems is a bar passing over each of said selected gems.

27. The method of manufacturing articles of jewelry according to claim 14, including the bonding together at least certain of said gems with an adhesive, wax or wax-like material that is eliminated from said second mold along with said removal of said wax preform material.

* * * * *

UNITED STATES PATENT AND TRADEMARK OFFICE

CERTIFICATE OF CORRECTION

PATENT NO. : 5,881,795
DATED : December 22, 1998
INVENTOR(S) : Linsley et al.

It is certified that error appears in the above-identified patent and that said Letters Patent is hereby corrected as shown below:

Column 9,
Line 26, delete “the” before the word “having”

Column 11,
Line 16, replace “s7” with -- B7 --

Signed and Sealed this

Fifth Day of April, 2005

JON W. DUDAS
*Director of the United States Patent and Trademark Office*

UNITED STATES PATENT AND TRADEMARK OFFICE

CERTIFICATE OF CORRECTION

PATENT NO. : 5,881,795
DATED : March 16, 1999
INVENTOR(S) : Clifford L. Uptain

It is certified that error appears in the above-identified patent and that said Letters Patent is hereby corrected as shown below:

This certifcate supersedes Certificate of Correction issued April 5, 2005. The certificate was issued in error and should be deleted.

Signed and Sealed this

Twenty-fourth Day of May, 2005

JON W. DUDAS
*Director of the United States Patent and Trademark Office*